US012662715B2

(12) United States Patent
Xu et al.

(10) Patent No.: US 12,662,715 B2
(45) Date of Patent: Jun. 23, 2026

(54) COMPREHENSIVE UTILIZATION METHOD FOR VALUABLE ELEMENTS IN HYDROMETALLURGICAL SLAG OF LATERITE NICKEL ORE

(71) Applicants: PT QMB NEW ENERGY MATERIALS, Jakarta (ID); PT ESG NEW ENERGY MATERIAL, Jakarta (ID); GEM CO., LTD., Shenzhen (CN); PT GEM INDONESIA NEW ENERGY MATERIALS, Jakarta (ID)

(72) Inventors: Kaihua Xu, Shenzhen (CN); Satryo Soemantri Brodjonegoro, Jakarta (ID); Guangyuan Wu, Jakarta (ID); Tegar Mukti Aji, Jakarta (ID); Andi Syaputra Hasibuan, Jakarta (ID); Rizky Wanaldi, Jakarta (ID); Evan Wahyu Kristiyanto, Jakarta (ID); Piyan Rahmadi, Jakarta (ID)

(73) Assignees: PT QMB NEW ENERGY MATERIALS, Jakarta (ID); PT ESG NEW ENERGY MATERIAL, Jakarta (ID); GEM CO., LTD., Shenzhen (CN); PT GEM INDONESIA NEW ENERGY MATERIALS, Jakarta (ID)

( * ) Notice: Subject to any disclaimer, the term of this patent is extended or adjusted under 35 U.S.C. 154(b) by 0 days.

(21) Appl. No.: 18/870,496

(22) PCT Filed: Jun. 29, 2023

(86) PCT No.: PCT/CN2023/103825
§ 371 (c)(1),
(2) Date: Nov. 29, 2024

(87) PCT Pub. No.: WO2025/000339
PCT Pub. Date: Jan. 2, 2025

(65) Prior Publication Data
US 2026/0043112 A1 Feb. 12, 2026

(51) Int. Cl.
*C22B 7/04* (2006.01)
*C22B 3/00* (2006.01)
(Continued)

(52) U.S. Cl.
CPC ..... *C22B 7/04* (2013.01); *C22B 3/22* (2013.01); *C22B 3/44* (2013.01); *C22B 7/007* (2013.01);
(Continued)

(58) Field of Classification Search
CPC ..... C01G 53/10; C01G 53/82; C01P 2004/61; C01P 2006/80; Y02P 10/20; C22B 23/0461; C22B 3/26; C22B 3/08
See application file for complete search history.

(56) References Cited

FOREIGN PATENT DOCUMENTS

CN 112226630 A 1/2021
WO WO-2014032095 A1 * 3/2014 ..... C22B 3/44

OTHER PUBLICATIONS

NPL: on-line translation of CN 11226630 A, Jan. 2021 (Year: 2021).*

(Continued)

*Primary Examiner* — Jie Yang
(74) *Attorney, Agent, or Firm* — Hemisphere Law, PLLC

(57) ABSTRACT

A comprehensive utilization method for valuable elements in hydrometallurgical slag of laterite nickel ore, comprising the following steps: S1. placing an iron-aluminum slag produced by laterite nickel ore hydrometallurgy in a tube furnace, and introducing an HCl gas stream for a one-stage distillation at 185-290° C. to obtain a one-stage distillation tail gas and a one-stage distillation residue; and condensing the one-stage distillation tail gas to obtain anhydrous $AlCl_3$; S2. introducing an HCl gas stream to the one-stage distillation residue for a two-stage distillation at 320-500° C. to obtain a two-stage distillation tail gas and a two-stage (Continued)

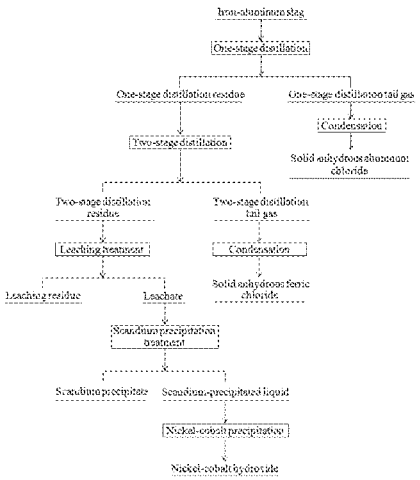

distillation residue; and condensing the two-stage distillation tail gas to obtain anhydrous $FeCl_3$; S3. subjecting the two-stage distillation residue to a leaching treatment by using a leaching solution to obtain a leaching residue and a leaching solution; subjecting the leaching solution to a scandium precipitation treatment to obtain a scandium precipitate and a de-scandiumed liquid; S4. adjusting the pH value of the de-scandiumed liquid to obtain an MHP. The obtained aluminum, iron, and scandium products have high purity and high recovery.

12 Claims, 1 Drawing Sheet

(51) Int. Cl.
*C22B 3/22* (2006.01)
*C22B 3/44* (2006.01)
*C22B 7/00* (2006.01)
*C22B 21/00* (2006.01)
*C22B 59/00* (2006.01)

(52) U.S. Cl.
CPC ..... *C22B 21/0023* (2013.01); *C22B 23/0423* (2013.01); *C22B 23/0461* (2013.01); *C22B 59/00* (2013.01)

(56) References Cited

OTHER PUBLICATIONS

Claims of PCT/CN2023/103825.
CNIPA (ISA), Written opinion for PCT/CN2023/103825, Dec. 21, 2023.

* cited by examiner

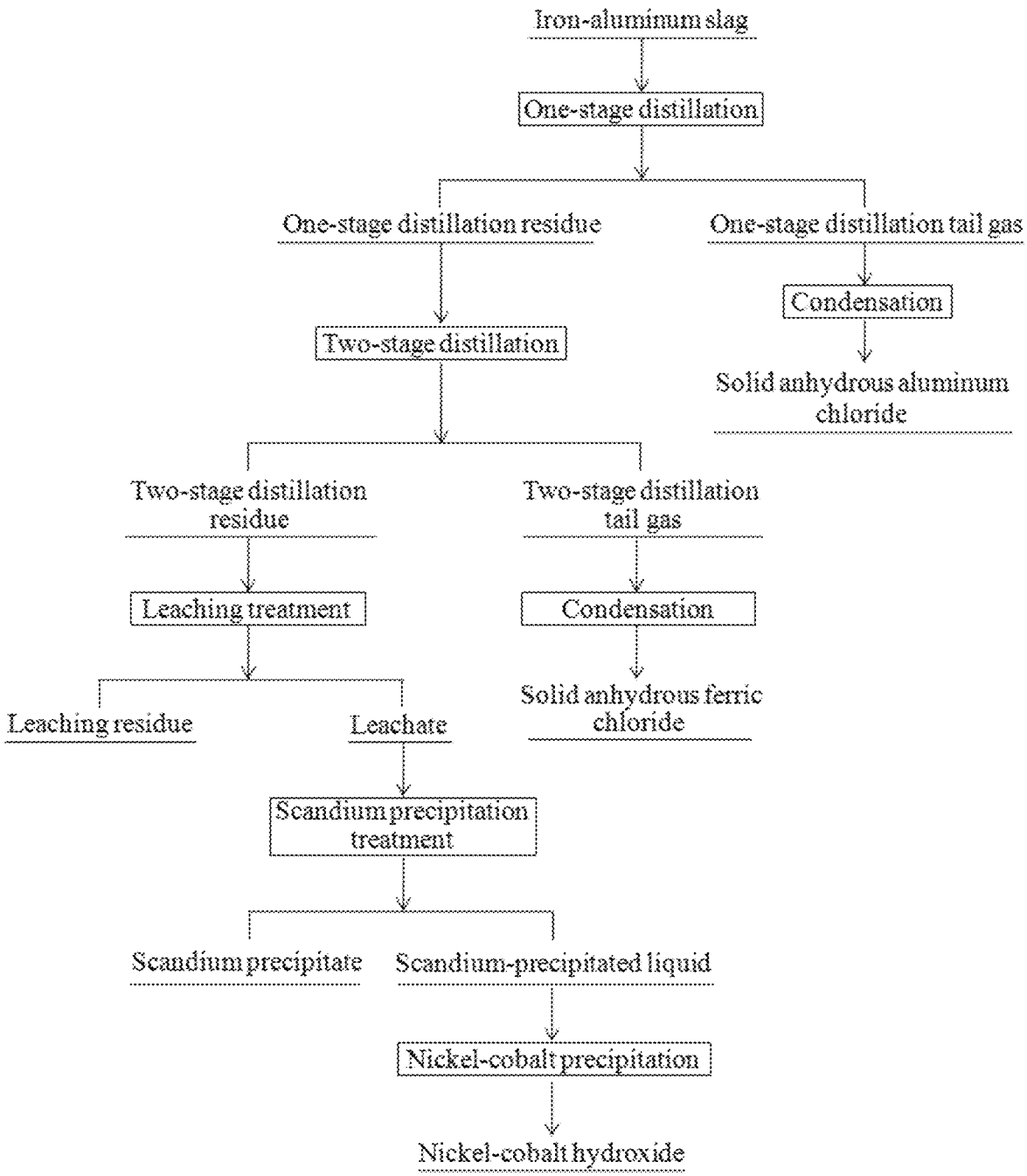
Iron-aluminum slag
One-stage distillation
One-stage distillation residue
One-stage distillation tail gas
Condensation
Solid anhydrous aluminum chloride
Two-stage distillation
Two-stage distillation residue
Two-stage distillation tail gas
Leaching treatment
Condensation
Solid anhydrous ferric chloride
Leaching residue
Leachate
Scandium precipitation treatment
Scandium precipitate
Scandium-precipitated liquid
Nickel-cobalt precipitation
Nickel-cobalt hydroxide

COMPREHENSIVE UTILIZATION METHOD FOR VALUABLE ELEMENTS IN HYDROMETALLURGICAL SLAG OF LATERITE NICKEL ORE

FIELD OF THE DISCLOSURE

The disclosure relates to the technical field of comprehensive utilization of laterite nickel ore, and more particularly, to a comprehensive utilization method for valuable elements in hydrometallurgical slag of laterite nickel ore.

BACKGROUND

Nickel has become a strategic metal resource as the pillar of the rapid development of new energy. As one of the main forms of nickel resources in nature, laterite nickel ore has been paid more and more attention. Among them, the laterite nickel ore hydrometallurgical process has been widely used in industrial production. In the hydrometallurgical process, a large amount of smelting waste is generated, among which the iron-aluminum slag contains metal Sc element with a grade between 0.05 and 0.5 wt. %, which is of a significant recycling and processing value.

Currently, most of the processes for extracting Sc from the Sc-containing slag are acid-base leaching or water leaching after calcination, and the enrichment of Sc is further achieved by means of extraction or precipitation. For example, the patent "CN103468979A" discloses a method for recovering scandium from the iron-aluminum slag of laterite nickel ore metallurgy by means of leaching and extraction.

However, since the aluminum content of the iron-aluminum slag is 10-30 times of scandium, and since the chemical properties of Sc and Al are very close, it is difficult to achieve effective separation of Al and Sc by using existing methods such as extraction or oxalate or hydroxide precipitation. Most of Sc will continue to enter the final aluminum or iron product along the treatment process, not only affecting the purity of the aluminum or iron products but also reducing the effective recovery of Sc.

SUMMARY

In view of this, the disclosure provides a comprehensive utilization method for valuable elements in hydrometallurgical slag of laterite nickel ore, and the obtained aluminum, iron, and scandium products have a high purity and a high recovery rate.

To achieve the above technical objectives, the disclosure adopts the following technical solutions:

The disclosure provides a comprehensive utilization method for valuable elements in hydrometallurgical slag of laterite nickel ore, comprising the following steps:

S1. placing an iron-aluminum slag produced by laterite nickel ore hydrometallurgy in a tube furnace, and introducing an HCl gas stream for a one-stage distillation at 185-290° C. to obtain a one-stage distillation tail gas and a one-stage distillation residue; and condensing the one-stage distillation tail gas to obtain anhydrous $AlCl_3$;

S2. introducing an HCl gas stream to the one-stage distillation residue for a two-stage distillation at 320-500° C. to obtain a two-stage distillation tail gas and a two-stage distillation residue; and condensing the two-stage distillation tail gas to obtain anhydrous $FeCl_3$;

S3. subjecting the two-stage distillation residue to a leaching treatment by using an extracting solution to obtain a leaching residue and a leaching solution; subjecting the leaching solution to a scandium precipitation treatment to obtain a scandium precipitate and a de-scandiumed liquid; and S4. adjusting the pH value of the de-scandiumed liquid for a precipitation treatment to obtain a Mixed Hydroxide Precipitate (MHP).

Preferably, step S1 further comprises absorbing the HCl gas stream after the one-stage distillation by using lye, and step S2 further comprises absorbing the HCl gas stream after the two-stage distillation by using lye.

Preferably, the extracting solution in step S3 is water or acid; the solid-liquid ratio of the two-stage distillation residue to the leaching solution is 50-200 g/L; the leaching temperature is 20-25° C.; and the leaching time is 0.5-2 h.

Preferably, the acid is one or more of an inorganic acid or an organic acid, and the concentration of the acid is 0.001-0.1 mol/L.

Preferably, in step S3, the scandium precipitation treatment comprises the following steps: adjusting the pH of the leaching solution to 4-6, and filtering to obtain the scandium precipitate and the de-scandiumed liquid, wherein the scandium precipitate is one or more of scandium hydroxide and scandium oxalate.

Preferably, step S3 further comprises calcining the scandium precipitate at 500-1000° C. for 0.5-5 h to obtain scandium oxide.

Preferably, the leaching residue comprises a mixture of $SiO_2$ and $CaSO_4$, and the leaching residue is used for the manufacture of environmentally friendly permeable brick or ceramsite.

Preferably, in step S4, the pH is 9-10.

Preferably, the flow rate of the HCl gas streams for the one-stage distillation and the two-stage distillation is 10-300 ml/min, and the introduction time is 0.5-3 h.

Preferably, the flow rate of HCl gas streams used in the one-stage distillation and the two-stage distillation is kept constant, and the concentration of the lye in step S1 and step S2 is kept constant.

Advantageous Effect of the Application

In the disclosure, deep separation of $AlCl_3$, $FeCl_3$, and $ScCl_3$ is achieved by staged distillation or sublimation, and the finally obtained iron, aluminum, and scandium products have high purity and high recovery rates.

The two-stage distillation gas streams used in the disclosure are both HCl gas streams, which can eliminate the process of chlorination of iron, aluminum and scandium in the pretreatment process, shorten the process flow and improve the production efficiency.

In addition to obtaining iron, aluminum, and scandium products with high purity and high recovery rate, the disclosure also obtains a leaching residue containing $SiO_2$ and $CaSO_4$, which can be used for manufacturing environment-friendly permeable brick or ceramsite. At the same time, Mixed Hydroxide Precipitate (MHP) can be obtained with a high yield, which realizes the recovery of nickel and cobalt. The produced products and by-products can be used in industrial applications, with less waste residue and waste liquid, environmentally friendly, and high commercial value.

BRIEF DESCRIPTION OF THE DRAWING

FIGURE is a process flow diagram of this scheme.

DETAILED DESCRIPTION OF PREFERRED EMBODIMENTS

In order that the objects, aspects, and advantages of the disclosure will become more apparent, a more particular description of the disclosure will be rendered by reference to the embodiments. It should be understood that the particular embodiments described herein are illustrative only and are not restrictive.

The disclosure provides a comprehensive utilization method for valuable elements in hydrometallurgical slag of laterite nickel ore, comprising the following steps:

S1. placing an iron-aluminum slag produced by laterite nickel ore hydrometallurgy in a tube furnace, and introducing an HCl gas stream for a one-stage distillation at 185-290° C. to obtain a one-stage distillation tail gas and a one-stage distillation residue; and condensing the one-stage distillation tail gas to obtain a solid anhydrous $AlCl_3$;

S2. introducing an HCl gas stream to the one-stage distillation residue for a two-stage distillation at 320-500° C. to obtain a two-stage distillation tail gas and a two-stage distillation residue; and condensing the two-stage distillation tail gas to obtain a solid anhydrous $FeCl_3$;

S3. subjecting the two-stage distillation residue to a leaching treatment by using an extracting solution to obtain a leaching residue and a leaching solution; subjecting the leaching solution to a scandium precipitation treatment to obtain a scandium precipitate and a de-scandiumed liquid; and S4. adjusting the pH value of the de-scandiumed liquid for a precipitation treatment to obtain MHP.

Based on the difference in the physical properties of iron, aluminum, and scandium metal chloride salts, i.e. the sublimation temperatures of $AlCl_3$, $FeCl_3$, and $ScCl_3$, the deep separation between the three can be achieved by the method of staged distillation or sublimation, so that the recovery rate of scandium is greatly improved and high-purity iron, aluminum and scandium related products can be obtained. Furthermore, there is a small amount of nickel and cobalt entrained in the iron-aluminum slag, and relevant nickel and cobalt MHP can also be simultaneously obtained through a recovery treatment. It should be noted that, since $AlCl_3$ (s), $FeCl_3$(s), and $ScCl_3$(s) are easily decomposed by direct heating distillation, for example, $2AlCl_3+3H_2O=Al_2O_3+6HCl$ would occur in the direct heating distillation of $AlCl_3$ (s), which would lead to the aluminum element remaining in the iron-aluminum slag without achieving the purpose of separation. In order to inhibit the above-mentioned chemical reactions, this scheme further proposes introducing an HCl gas stream during the heating distillation to achieve a good effect, and it is unexpectedly found that the process of chlorination of iron, aluminum, and scandium in the pretreatment process can be omitted by using the HCl gas stream.

As known to a person skilled in the art, iron, aluminum, scandium, etc. in the iron-aluminum slag exist in the form of hydroxides. In the process of introducing the HCl gas stream in the present scheme, the following reactions gradually occur by controlling the distillation temperature:

$$(Fe,Al,Sc)(OH)_3+3HCl=(Fe,Al,Sc)Cl_3+3H_2O \quad (1);$$

the hydroxides of iron, aluminum, and scandium are respectively converted into the corresponding solid salts by introducing HCl;

$$AlCl_3(s)\rightarrow AlCl_3(g) \quad (2);$$

$AlCl_3$ is sublimated from a solid state(s) to a gas state (g) by controlling T (185-290° C.) under introducing HCl;

$$FeCl_3(s)\rightarrow FeCl_3(g) \quad (3);$$

$FeCl_3$ is sublimated from a solid state(s) to a gas state (g) by controlling T (320-500° C.) under introducing HCl;

However, since the sublimation process conditions of $ScCl_3(s)\rightarrow ScCl_3(g)$ require higher (only occurs when T>850° C.) and consume higher energy, and since the subsequent treatment steps of the three-stage distillation tail gas and the three-stage distillation residue obtained after performing the three-stage distillation are complicated, after performing the two-stage distillation in the disclosure, the method of leaching-scandium precipitation-nickel-cobalt precipitation is used for post-treatment to obtain a high-value by-product, saving energy.

Step S1 further comprises absorbing the HCl gas stream after the one-stage distillation by using lye, and step S2 further comprises absorbing the HCl gas stream after the two-stage distillation by using lye; that is to say after the distillation tail gas is firstly connected to the condensation collection device, the remaining gas after condensation is introduced into the lye for absorption. In order to fully condense the $AlCl_3$ and $FeCl_3$, the condensation collection device may be repeatedly provided in multiple numbers. The lye used includes but is not limited to one or more of ammonia and sodium hydroxide, and the concentration of the lye is 1-3 mol/L.

In step S3, the extracting solution is water or acid, the solid-liquid ratio of the two-stage distillation residue to the leaching solution is 50-200 g/L; the leaching temperature is 20-25° C.; and the leaching time is 0.5-2 h. Through leaching treatment, the leaching residue containing $SiO_2$ and $CaSO_4$ and a leaching solution containing scandium salt and nickel-cobalt salt can be obtained. $SiO_2$ and $CaSO_4$ with the maximum leaching effect can be obtained under this solid-liquid ratio definition. The leaching residue comprises a mixture of $SiO_2$ and $CaSO_4$, the leaching residue being used for the manufacture of environmentally friendly permeable brick or ceramsite.

The acid is one or more of an inorganic acid or an organic acid, and the concentration of the acid is 0.001-0.1 mol/L; too high an acid concentration will dissolve calcium sulfate and too low an acid concentration will not leach.

In step S3, the scandium precipitation treatment comprises the following steps:

adjusting the pH of the leaching solution to 4-6 and filtering to obtain the scandium precipitate and the de-scandiumed liquid, wherein the scandium precipitate is one or more of scandium hydroxide and scandium oxalate.

Step S3 further comprises calcining the scandium precipitate at 500-1000° C. for 0.5-5 h to obtain scandium oxide.

By the scandium precipitation-calcination treatment in step S3, scandium oxide with a purity of >99% can be obtained. The de-scandiumed liquid can then be used to recover MHP.

In step S4, the pH is 9-10, at which pH range, nickel, and cobalt can precipitate and form Mixed Hydroxide Precipitate (MHP) and a small amount of nickel cobalt carbonate.

The flow rate of the HCl gas stream of the one-stage distillation and the two-stage distillation is 10-300 ml/min, and the introduction time is 0.5-3 h; under this flow rate and time definition, $AlCl_3$ and $FeCl_3$ are fully distilled and sublimated.

The flow rate of the HCl gas stream used in the one-stage distillation and the two-stage distillation is kept constant, and the concentration of the lye in step S1 and step S2 is kept constant, beneficial to maintaining the stability of process conditions, reducing the number of adjustments, and saving resources.

The following provides further explanation of this scheme through specific examples.

EXAMPLE 1

A comprehensive utilization method for valuable elements in hydrometallurgical slag of laterite nickel ore included the following steps:

S1. 1 kg of iron-aluminum slag produced by laterite nickel ore hydrometallurgy was taken and placed in a tube furnace. An HCl stream flow was introduced at a flow rate of 30 ml/min. The distillation was performed at a temperature of 200° C. for 2 h, so as to obtain a one-stage distillation tail gas and a one-stage distillation residue. The one-stage distillation tail gas was subjected to condensing using a circulating water device to collect solid anhydrous aluminum chloride with a purity of 99.52% and a yield of 92.14%. The condensed distillation tail gas (HCl gas stream) was introduced into lye for absorption, wherein the lye was a NaOH solution with a concentration of 1 mol/L. The yield of anhydrous aluminum chloride was obtained by dividing the aluminum element content of the obtained anhydrous aluminum chloride by the aluminum element content in the original iron-aluminum slag phase, and the aluminum element content in the original iron-aluminum slag phase was determined by ICP.

S2. The temperature of the one-stage distillation residue was kept for 2 h and then continued to be increased to 400° C. and kept at this temperature for 2 h. The flow rate of the HCl gas was controlled to be constant. After distillation and sublimation, a two-stage distillation tail gas and a two-stage distillation residue were obtained. The two-stage distillation tail gas was condensed through a circulating water condensation device to collect solid anhydrous ferric chloride with a purity of 99.33% and a ferric chloride yield of 90.45%. The condensed distillation tail gas (the HCl gas stream) was introduced into lye for absorption, wherein the type and the concentration of the lye were constant. The yield of anhydrous ferric chloride was obtained by dividing the iron element content of the obtained anhydrous ferric chloride by the iron element content in the original iron-aluminum slag phase, and the iron element content in the original iron-aluminum slag phase was determined by ICP.

S3. The two-stage distillation residue was leached with 0.01 mol/L sulfuric acid. The solid-liquid ratio was controlled to be 100 g/L, the time to be 30 min, and the temperature to be 20-25° C. to obtain a leaching residue and a leaching solution. The leaching residue was a mixture of $SiO_2$ and $CaSO_4$, which can be used for manufacturing environmentally friendly permeable brick or ceramsite. The leaching solution was an Sc enrichment solution and an enrichment residue. The pH of the leaching solution was adjusted to 5 using a liquid alkali. A scandium precipitate and a de-scandiumed liquid were obtained by filtering. The scandium precipitate was $Sc(OH)_3$. The scandium precipitate was calcined at a temperature of 600° C. for 1 h to obtain $Sc_2O_3$ with a purity of 99.12%; and the yield of Sc was 97.34%. The pH of the de-scandiumed liquid was further adjusted to 10 by using a liquid alkali, and a Mixed Hydroxide Precipitate (MHP) was obtained by filtering the precipitate, with a nickel-cobalt yield of 95.25%. The yields of Sc, nickel, and cobalt were calculated in the same manner as the yield of aluminum in step S1.

EXAMPLE 2

A comprehensive utilization method for valuable elements in hydrometallurgical slag of laterite nickel ore. The other contents were the same as those in example 1, except that the one-stage distillation temperature was 185° C.; a liquid anhydrous aluminum chloride was collected with a purity of 92.15%; the yield of anhydrous aluminum chloride was 85.28%; the two-stage distillation temperature was 500° C.; a liquid anhydrous ferric chloride was collected with a purity of 98.34%; the yield of ferric chloride was 91.52%; the pH of the leaching solution was adjusted to 4; $Sc_2O_3$ was obtained with a purity of 96.66%; the yield of Sc was 96.21%; the pH of the de-scandiumed liquid was adjusted to 9; and the yield of nickel-cobalt was 93.37%.

EXAMPLE 3

A comprehensive utilization method for valuable elements in hydrometallurgical slag of laterite nickel ore. The other contents were the same as those in example 1, except that the one-stage distillation temperature was 290° C.; a liquid anhydrous aluminum chloride was collected with a purity of 99.31%; the yield of anhydrous aluminum chloride was 95.29%; the two-stage distillation temperature was 320° C.; a liquid anhydrous ferric chloride was collected with a purity of 99.36%; the yield of ferric chloride was 82.58%; the pH of the leaching solution was adjusted to 6; $Sc_2O_3$ was obtained with a purity of 95.45%; the yield of Sc was 95.39%; and the yield of nickel-cobalt was 97.44%.

COMPARATIVE EXAMPLE 1

A comprehensive utilization method for valuable elements in hydrometallurgical slag of laterite nickel ore. The other contents were the same as those in example 1, except that the one-stage distillation temperature and the two-stage distillation temperature were both 200° C.; liquid anhydrous aluminum chloride was collected with a purity of 99.28%; the yield of anhydrous aluminum chloride was 92.63%; almost no ferric chloride was collected; the purity of $Sc_2O_3$ was 90.52%; the yield of Sc was 80.94%; and the yield of nickel-cobalt was 80.39%.

COMPARATIVE EXAMPLE 2

A comprehensive utilization method for valuable elements in hydrometallurgical slag of laterite nickel ore. The other contents were the same as in Example 1, except that the temperature for the one-stage distillation and the temperature for the two-stage distillation were both 400° C.; liquid anhydrous aluminum chloride was collected with a purity of 75.85%; the yield of anhydrous aluminum chloride was 96.64%; anhydrous ferric chloride was collected with a purity of 95.59%; the yield of anhydrous ferric chloride was 73.74%; $Sc_2O_3$ was obtained with a purity of 92.29%; the yield of Sc was 83.68%; and the yield of nickel-cobalt was 84.55%.

It can be seen that in the disclosure, deep separation of $AlCl_3$, $FeCl_3$, and $ScCl_3$ is achieved by staged distillation or sublimation, and the finally obtained iron, aluminum, and scandium products have high purity and high recovery rates.

The above is only the preferred specific implementation method of the disclosure, and the scope of the disclosure is not limited to this. Any changes or replacements that can be easily thought of by technical personnel familiar with the technical field within the scope of disclosure in the disclosure should be covered within the scope of the disclosure.

What is claimed is:

1. A comprehensive utilization method for valuable elements in hydrometallurgical slag of laterite nickel ore, characterized by comprising the following steps:

S1, placing an iron-aluminum slag produced by laterite nickel ore hydrometallurgy in a tube furnace, and introducing an HCl gas stream for a one-stage distillation at 185-290° C. to obtain a one-stage distillation tail gas and a one-stage distillation residue; and condensing the one-stage distillation tail gas to obtain anhydrous $AlCl_3$;

S2, introducing an HCl gas stream to the one-stage distillation residue for a two-stage distillation at 320-500° C. to obtain a two-stage distillation tail gas and a two-stage distillation residue; and condensing the two-stage distillation tail gas to obtain anhydrous $FeCl_3$;

S3, subjecting the two-stage distillation residue to a leaching treatment by using an extracting solution to obtain a leaching residue and a leaching solution; subjecting the leaching solution to a scandium precipitation treatment to obtain a scandium precipitate and a de-scandiumed liquid; and S4, adjusting the pH value of the de-scandiumed liquid for a precipitation treatment to obtain a mixed hydroxide precipitate (MHP).

2. The comprehensive utilization method for valuable elements in hydrometallurgical slag of laterite nickel ore according to claim 1, wherein step S1 further comprises absorbing the HCl gas stream after the one-stage distillation by using lye, and step S2 further comprises absorbing the HCl gas stream after the two-stage distillation by using lye.

3. The comprehensive utilization method for valuable elements in hydrometallurgical slag of laterite nickel ore according to claim 2, wherein the flow rate of HCl gas streams used in the one-stage distillation and the two-stage distillation is kept constant, and the concentration of the lye in step S1 and step S2 is kept constant.

4. The comprehensive utilization method for valuable elements in hydrometallurgical slag of laterite nickel ore according to claim 1, wherein the extracting solution in step S3 is water or acid; the solid-liquid ratio of the two-stage distillation residue to the leaching solution is 50-200 g/L; the leaching temperature is 20-25° C.; and the leaching time is 0.5-2 h.

5. The comprehensive utilization method for valuable elements in hydrometallurgical slag of laterite nickel ore according to claim 3, wherein the acid is one or more of inorganic acid or organic acid, and the concentration of the acid is 0.001-0.1 mol/L.

6. The comprehensive utilization method for valuable elements in hydrometallurgical slag of laterite nickel ore according to claim 1, wherein in step S3, the scandium precipitation treatment comprises the following steps: adjusting the pH of the leaching solution to 4-6 and filtering to obtain the scandium precipitate and the de-scandiumed liquid, wherein the scandium precipitate is one or more of scandium hydroxide and scandium oxalate.

7. The comprehensive utilization method for valuable elements in hydrometallurgical slag of laterite nickel ore according to claim 1, wherein step S3 further comprises calcining the scandium precipitate at 500-1000° C. for 0.5-5 h to obtain scandium oxide.

8. The comprehensive utilization method for valuable elements in hydrometallurgical slag of laterite nickel ore according to claim 1, wherein the leaching residue comprises a mixture of $SiO_2$ and $CaSO_4$, the leaching residue being used for the manufacture of environmentally friendly permeable brick or ceramsite.

9. The comprehensive utilization method for valuable elements in hydrometallurgical slag of laterite nickel ore according to claim 1, wherein in step S4, the pH is 9-10.

10. The comprehensive utilization method for valuable elements in hydrometallurgical slag of laterite nickel ore according to claim 1, wherein the flow rate of the HCl gas streams for the one-stage distillation and the two-stage distillation is 10-300 ml/min, and the introduction time is 0.5-3 h.

11. The comprehensive utilization method for valuable elements in hydrometallurgical slag of laterite nickel ore according to claim 1, wherein in the process of introducing the HCl gas stream, the following reactions gradually occur by controlling the distillation temperature:

the hydroxides of iron, aluminum, and scandium are respectively converted into the corresponding solid salts by introducing HCl;

$AlCl_3$ is sublimated from a solid state(s) to a gas state (g) by controlling T (185-290° C.) under introducing HCl; and $FeCl_3$ is sublimated from a solid state(s) to a gas state (g) by controlling T (320-500° C.) under introducing HCl.

12. The comprehensive utilization method for valuable elements in hydrometallurgical slag of laterite nickel ore according to claim 1, wherein the lye comprises one or more of ammonia and sodium hydroxide, and the concentration of the lye is 1-3 mol/L.

* * * * *